United States Patent [19]

Adler et al.

[11] 4,024,843

[45] May 24, 1977

[54] FUEL INJECTION SYSTEM FOR COMBINATION WITH INTERNAL COMBUSTION ENGINES, HAVING A UNIVERSALLY CONNECTABLE INPUT TRIGGER STAGE

[75] Inventors: Karl-Heinz Adler, Leonberg; Ulrich Drews, Vaihingen, Enz-Pulverdingen; Erwin Gloss, Korntal; Adolf Kugelmann, Leonberg, all of Germany

[73] Assignee: Robert Bosch GmbH, Stuttgart, Germany

[22] Filed: Dec. 2, 1975

[21] Appl. No.: 637,062

[30] Foreign Application Priority Data

Jan. 25, 1975 Germany ..... 2503108

[52] U.S. Cl. ..... 123/32 ED; 123/148 E; 307/200 R

[51] Int. Cl.² ..... F02B 3/00

[58] Field of Search ..... 123/32 EA, 117 R, 102, 123/148 E; 317/9 B, 9 C, 50

[56] References Cited

UNITED STATES PATENTS 3,648,798 3/1972 Jania ..... 123/102

*Primary Examiner*—Ronald B. Cox
*Attorney, Agent, or Firm*—Flynn & Frishauf

[57] ABSTRACT

To permit connection of the input trigger stage to a wide variety of signal sources, such as different types of ignition systems (transistorized ignitions, coil-type ignitions, mechanical breaker system ignitions, and the like), a voltage divider is connected across the supply circuit, and the input signal is applied to a dual collector transistor forming the trigger or threshold stage, one collector of the transistor being connected to the output of the trigger stage and the other being connected to a protective circuit controlling bypassing of input signals of excessive voltage, or energy of either polarity and thus protecting the dual collector transistor.

14 Claims, 4 Drawing Figures

FUEL INJECTION SYSTEM FOR COMBINATION WITH INTERNAL COMBUSTION ENGINES, HAVING A UNIVERSALLY CONNECTABLE INPUT TRIGGER STAGE

CROSS REFERENCE TO RELATED PATENTS

U.S. Pat. No. 3,483,851 (Reichardt);
U.S. Pat. No. 3,874,171 (Schmidt et al);
U.S. Pat. No. 3,827,237 (Linder et al),
all asigned to the assignee of the present application.

The present invention related to a fuel injection system for internal combustion engines and more particularly to such a system for automotive-type internal combustion engines powered from a vehicle battery.

Fuel injection systems for internal combustion engines are usually operated from a vehicle battery which supplies the operating power for fuel injection valves, as well as operating power for the entire system. Such fuel injection systems usually cause injection events to occur in dependence on rotational speed of the engine; to trigger the injection events, an electrical voltage is derived, typically from the primary side of the ignition coil of the engine, although separate voltage sources could be used providing trigger pulses in synchronism with engine rotation. The voltage from the primary of the ignition coil can also be used as a pulse source to derive engine speed information therefrom.

Recently, the type of ignition systems used with internal combustion engines and particularly with automotive-type internal combustion engines has become more diversified; some ignition systems continue to use mechanical breaker contacts; others use semiconductors, typically transistors, to switch the primary current through the ignition coil. Other circuits have been proposed and are being used in internal combustion engines in which the mechanical breaker contacts are eliminated entirely, using, instead, thyristor or transistor circuits. Other types of ignition systems use energy storage devices, typically capacitors, which cooperate with suitable inductances to provide the ignition voltage. These various types of ignition systems provide signal voltages of greatly varying levels. In some of these ignition systems, the signal voltage does not exceed the level of the positive voltage available, at any instant of time, from the vehicle battery. Other types of ignition systems, however, provide signal voltages which may be either positive or negative, are of substantial energy, and may have an amplitude of several hundred volts.

It is, accordingly, one object of the invention to provide a fuel injection system having a trigger circuit which is capable of accepting operating voltages in a wide voltage range, for example between 6 to 20 V, and reliably operating in a wide temperature range, for example from −30 ° to +85 ° C, and which can be controlled by any known ignition system and is capable of accepting the signal voltages supplied by any one of these systems.

Trigger circuits for automotive-type ignition systems have been proposed in which the signal voltage is higher that the supply voltage. Other trigger circuits are known in which the trigger thresholds are close to the zero-voltage level of the supply voltage, and which are essentially independent of change in supply voltage. All these known trigger circuits are, however, sensitive with respect to stray or noise pulses and short-time voltage swings or instantaneous interruptions, and thus provide a trigger output pulse even if the input voltage should be approximately constant, although the input voltage, in general, changes within wide limits with the supply voltage. As a result, such circuits are usually too sensitive and can operate only within limited ranges of input parameters; they usually require individual matching of the particular trigger system to the particular ignition system of a particular internal combustion engine.

It is, therefore, a further object of the present invention to provide a fuel injection system having an input trigger circuit which is essentially universally applicable to any type of engine without requiring extensive or, preferably, any individual matching adjustments.

SUBJECT MATTER OF THE PRESENT INVENTION

Briefly, the fuel injection system has a power stage which provides fuel injection pulses to fuel injection valves, the trigger system as well as the power stage being energized by a battery. The trigger stage of the fuel injection system which, eventually, controls the duration of the pulse applied to the fuel injection valve, includes a voltage divider and a double-collector transistor having its base connected to a tap point of the voltage divider which is connected to the input to the trigger stage. A protective circuit is provided which protects the trigger stage from overloading as well as undesired triggering of the stage if the input signal should have excessive power. One collector of the double-collector transistor is connected to the output of the trigger stage and, thus, eventually controls the opening of the fuel injection valve; the other collector of the double-collector transistor is connected to control the protective circuit.

In accordance with a feature of the invention, the trigger stage is particularly suitable to be constructed as a monolithic integrated circuit.

The invention will be described by way of example with reference to the accompanying drawings, wherein.

Figure 1:
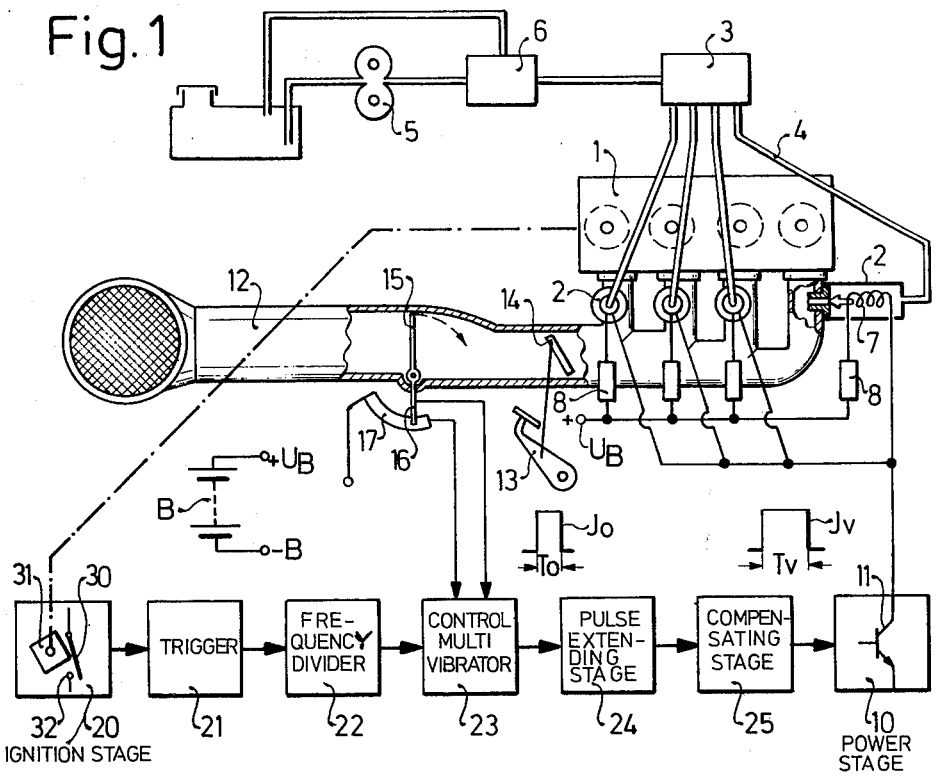
FIG. 1 is a general schematic diagram of an internal combustion engine and a fuel injection system and illustrating the triggering arrangement for the fuel injection system.

The fuel injection system is adapted for operation with battery-supplied ignition. It will be illustrated with a four-cylinder, four-cycle internal combustion engine 1, although it is applicable to different types of internal combustion engines, with different numbers of cylinders. Four electromagnetically operated injection valves 2 receive fuel from a fuel distributor 3. The fuel is pressurized and supplied over pressurized supply lines 4. An electrically driven fuel supply pump 5 supplies fuel from a fuel tank through a pressure regulator 6 to the distributor 3. The pressure of the fuel, as controlled by regulator 6, is about 2 atm.

The electronic control system is triggered once at each revolution of the crankshaft of the engine, as will be described below. An essentially square electrical opening pulse Jv is supplied by the fuel injection system to the fuel injection valves 2. The time duration Tv of the fuel injection pulse Jv determines the opening time of the fuel injection valve 2, and hence the quantity of fuel which is emitted from the injection valves 2 during the open-state thereof.

The fuel injection valves 2 are operated by solenoid coils 7, only one which is shown. The coils 7 are connected through decoupling or isolating resistors 8 to a common positive supply line. They are connected, further, to a power stage 10 which includes at least one power transistor 11, the emitter-collector path of which is serially connected with one or all of the magnet windings 7. The emitter of the power transistor 11 is connected to ground or chassis, that is, to the negative terminal of the vehicle battery, not shown, the positive terminal of which is connected to the decoupling resistors 8.

The quantity of air which is admitted to the particular cylinder, during the suction smoke thereof, determines the amount of fuel which is to be supplied and which can be completely burned during the subsequent power stroke. This is common operation of externally ignited internal combustion engines, in which a fuel-air mixture is compressed. For efficient utilization of such an engine and of the fuel supply thereto, the air-fuel mixture should be carefully proportioned so that after combustion there is no substantial excess of air or fuel. The quantity of air being sucked into the pistons is controlled by a throttle 14 located in the induction pipe of the internal combustion engine. Throttle 14 is operated by accelerator pedal 13. To measure the quantity of air being supplied, a deflection vane 15 is located in the induction pipe of the engine. Vane 15 deflects counter the force of a return spring, not shown, in dependence on the quantity of air being sucked in by the internal combustion engine. The shaft of the deflection vane 15 is coupled to the slider 16 of an electrical potentiometer 17 which provides a control voltage in dependence on the deflection of vane 15 for the fuel injection system.

The ignition system of the internal combustion engine has an ignition stage 20 in which a breaker contact 30 is cyclically opened, that is, is lifted off stationary contact 32 in synchronism with rotation of engine 1, by engagement of the corners of the breaker cam 31 with the movable breaker contact 30. The ignition system 20 thus provides pulses which are applied to a trigger stage 21. It is this trigger stage which forms the essential component of the present invention. The output of trigger stage 21 is applied to the frequency divider 22, the output of which is connected to a control multivibrator (MV) 23, which also has the output of potentiometer 17 applied thereto. A pulse extending stage 24 is connected to the output of the control MV 23, the output of which is connected to a compensating stage 25. Compensating stage 25 has an input applied thereto representative of battery voltage of the system to modify the pulse so that the eventual injection time of the valve 2 will be independent of variations of battery voltage $U_B$. The output from compensating stage 25 is applied to power stage 10 to control the operation of transistor 11 and hence the energization of injection valves 2.

The control MV 23 provides a control pulse Jo at its output, which has a pulse duration To. The pulse duration depends on the voltage applied thereto from potentiometer 17, that is, on the mass rate of air being supplied to the internal combustion engine, and further depends on engine speed. These control pulses Jo are extended in the pulse extending stage 24 by a factor *f*. This factor *f* depends on engine operating, operation, or ambient conditions, for example on the position of the accelerator pedal 13, whether the engine is operating under starting conditions, whether it has just been started, whether it is warming up, and further on engine temperature, for example temperature of its cooling water, or of its engine block. Information regarding composition of the exhaust gases may also be applied to the pulse extending stage to either extend or reduce the length of the pulses for optimum exhaust emission from the engine. The pulse Jo is thus modified in the pulse extending stage 24 to provide an output pulse Jv of time Tv. This pulse Jv is modified in the compensating stage 25 to compensate for change in operation of the valves 2 upon changes in supply voltage from the battery, that is, upon changes of battery voltage $U_B$. The pulse Jv is widened, for example, upon drop in battery voltage.

The rising flank of the pulses Jo and Jv occurs simultaneously (neglecting timing losses in the apparatus, which are negligible). Thus, triggering of the pulses Jv occurs synchronously with rotation of the crankshaft of engine 1, since the trigger signal generator for the system is the ignition breaker contact 30, 32 cooperating with the ignition cam and forming part of the ignition distributor system (not further shown). The signal is derived from the fixed breaker contact 32. This fixed breaker contact is connected to the primary 33 (FIG. 2) of the ignition coil of the engine.

FIG. 1 shows, further, the battery B which supplies operating voltage $U_B$. This voltage $U_B$ may vary widely, and may also differ for different vehicles, that is, for different engines 1.

Figure 2:
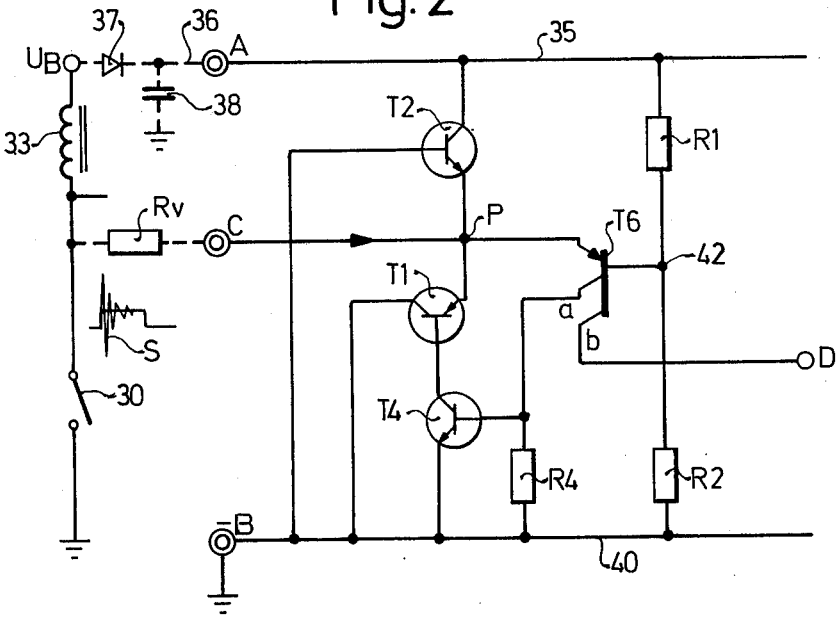
FIG. 2 is a simplified schematic circuit diagram for a trigger stage having a simple voltage divider.

One embodiment of the circuit in accordance with the present invention is shown in FIG. 2, in which the trigger stage 21 is illustrated in greater detail. The circuit of FIG. 2 is intended to be constructed in integrated circuit technology. It has an input terminal C, a terminal A connected to a common positive bus 35 and arranged for connection to the battery B by means of a connecting line or cable branch 36, shown in broken lines. A diode 37 is connected in line 36 to prevent damage to the circuit in case the circuit is connected with the reverse polarity. A noise suppression capacitor 38 is connected between the diode 37 and terminal A. Capacitor 38 bypasses stray noise peaks which may be transferred to terminal A and which may arise when other loads connected to battery B are switched. Terminal -B is connected to ground or chassis, and is further connected to the negative terminal of the battery B, as well as to the chassis bus 40 in the circuit of FIG. 2, which forms the trigger stage 21.

Trigger stage 21 includes a voltage divider connected between positive and negative buses 35, 40, and formed of resistors R1, R2. The tap or junction point 42 of the voltage divider is connected to the base of a transistor T6 which is of the double collector type. Transistor T6 has a first or a-collector, and a second or b-collector. The emitter of the transistor T6, which is of the switching transistor type, is connected to the input terminal C and receives a trigger signal S (FIG. 2) derived from a coupling resistor Rv. The trigger current is limited to 50 to 60 nA by the resistor Rv. This trigger current flows to the junction P to which, besides the emitter of switching transistor T6, the emitters of two transistors T1, T2 are likewise connected. The transistors T1, T2, in combination with a further transistor T4, form a protective circuit which is provided to bypass excessive input currents if the trigger signal S has excessive positive or negative values.

A dual collector a, b of the switching transistor T6 can easily be made in integrated circuit technology. The collector current distribution of the transistor is determined by the ratio of surface of the two collectors. It is so selected that the portion of the collector current flowing in the b-collector of the transistors T6 is sufficient to control a subsequent stage connected to the output terminal D, for example the frequency division stage 22, at the lowest expected input voltage. This may, for example, be an input voltage which just reaches the upper third of the nominal battery voltage, that is, in a nominal battery voltage of 12 V, about 8 V. If the trigger signal is derived from a breaker system which is different from that for which it was intended, that is, from one in which the input voltage rises substantially above the nominal value of 12 V, even if the trigger stage has already responded, then the current flowing in the a-collector of transistor T6, in combination with the collector resistor R4, ensures that the subsequently connected transistors T4 and T1 are then turned ON, so that the major portion of the control current applied to the input terminal C can be conducted to ground or chassis. The control current, therefore, as applied to terminal C may be a multiple of the current actually drawn by the trigger switching transistor T6, and which is further applied to the output terminal D. The trigger signal may also have a voltage which is substantially higher, for example, it may have a voltage which is fifty times as great as nominal battery voltage, that is, the voltage between positive and negative buses 35, 40 of the trigger stage itself. Such voltages may arise when ignition coil triggering is used for the spark plugs.

The transistor T1 is a pnp-transistor, and is provided so that a negative input signal, if applied, is blocked by the base-emitter path of the transistor T1 so that reverse polarity, and hence inverse operation of the elements short-circuiting or bypassing excessive trigger currents, that is, transistor T4, is prevented. In monolithic, integrated technology, transistor T1 preferably is constructed as a vertical transistor.

High input currents are thus bypassed, ensuring that the voltage at terminal C is increased with respect to the voltage of the top or junction point 42 of the voltage divider R1, R2 only by the diode voltage of the emitterbase path of the transistor T6; this diode voltage is about 0.7 V, and thus the voltage at the terminal C is clamped to be substantially below the voltage of the terminal A. Unless this voltage relationship is assured, a pnp-transistor which is inherently obtained when constructing the integrated circuit might become active and thus result in malfunctioning not only of the trigger stage, but also in providing signals to the subsequent stages and circuit components controlled thereby, which can all be integrated on the same semiconductor chip. This spurious pnp-transistor is formed by the p-zone of the resistors R1, R2, the n-resistance trough and the p-zone of adjacent resistors.

Figure 3:
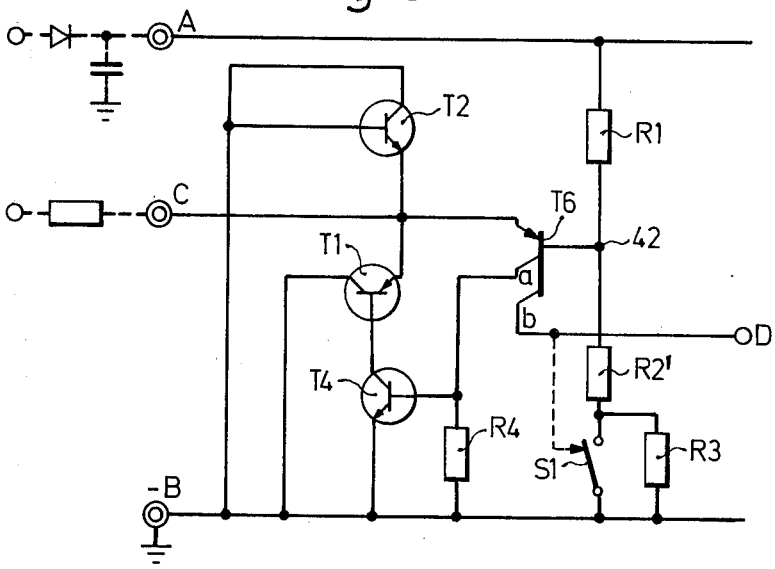
FIG. 3 is a simplified circuit diagram of another embodiment of a trigger stage having a switchable voltage divider.

A trigger signal S derived from the ignition system may have highly negative voltage values; if so, then one of the semiconductor paths, particularly the emitter-base path of transistor T6 may break down. To prevent such breakdown, the voltage at terminal C is clamped to a value which can be less negative than the voltage of the negative bus 40 only by the value of the emitter-base diode voltage of transistor T2. If the trigger signal has negative voltage values in excess of this diode voltage, transistor T2 becomes conductive. Its collector must not go into saturation, however, since this might influence adjacent elements of the integrated circuit. To prevent saturation of the collector of transistor T2, the collector is preferably made in low-ohm, or low-resistance construction. As illustrated in FIG. 3, it can be connected to negative bus 40, that is, to the base thereof. This requires a comparatively large surface area for the transistor T2 on the chip. In order to reduce the surface area required for the transistor T2, the collector of the transistor T2 can be connected to the positive bus 35, as shown in FIG. 2, and not to the base thereof.

Figure 4:
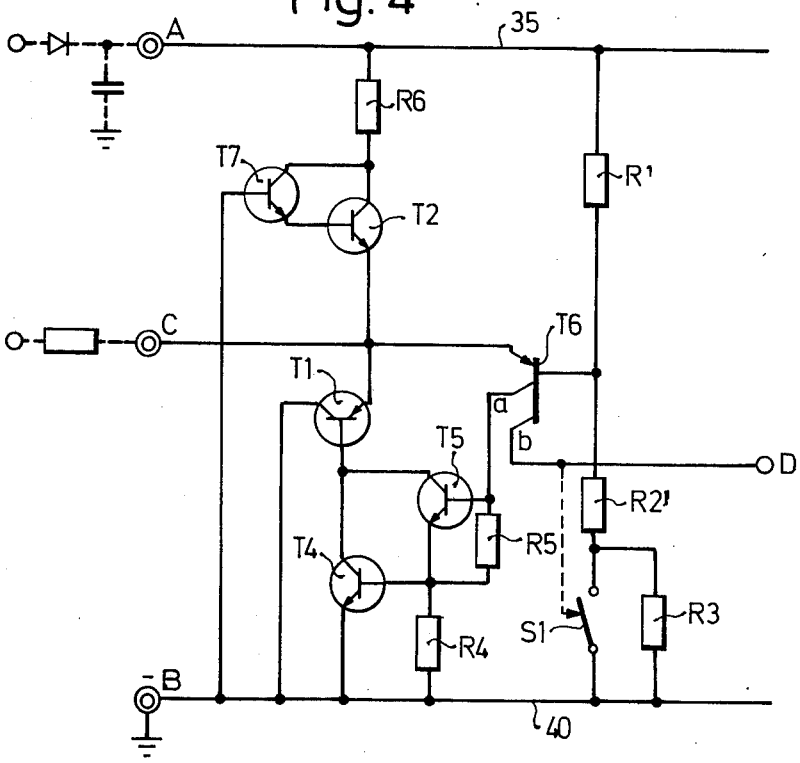
FIG. 4 is another embodiment of a trigger stage having improved performance, but a greater number of components.

FIG. 4 illustrates a trigger stage in accordance with the present invention in which the transistor T2 is part of a Darlington stage, by adding a further transistor T7 to transistor T2. A Darlington stage ensures that the emitter-base path of the transistor T2 cannot break down at positive values of the trigger signal. A resistor R6 is further connected in the collectors to the transistors T2, T7 which protects the Darlington stage against overloading.

If the trigger stage is connected to a coil ignition system, and directly to the breaker contact 30, multiple trigger pulses may be derived due to high-frequency oscillations at the contact terminals. Thus, erroneous trigger pulses may be generated and transmitted to the system.

The circuits of FIG. 4 show an embodiment in which the voltage division ratio which determines the trigger threshold value can be made variable, that is, can be switched, so that the trigger stage will have hysteresis in the sense that, when the trigger threshold is first passed, the trigger threshold is immediately lowered by a predetermined value. Thus, an instantaneous, or short-time collapse of the rising flank of the input signal at terminal C does not cause further triggering, after the trigger stage has first responded. The resistor R2 (FIG. 2) is subdivided into two resistors R2′ and R3. The resistor R3 can be short-circuited by a switch S1, shown as a mechanical switch although, in actual construction, it will be an electronic switch. The base voltage of the transistor T6, and thus the trigger threshold, is dropped for a short period of time upon closing of switch S1. The switch S1 can be controlled either by the trigger stage itself, that is, by a feedback from output terminal D, or by a subsequent stage; preferably, it is a switching transistor integrated on the same chip as the remainder of the circuit.

Pnp-transistors, when constructed in integrated circuit technology, have only relatively low current amplification, and are subject to dispersion. In order to ensure that even with low current amplification, when using pnp-transistors, high input current can be derived from transistor T6, the current flowing in the a-collector of transistor T6 is amplified by a Darlington stage formed by transistors T4, T5, the collectors of which are both connected to the base of the transistor T1, as seen in FIG. 4. Resistor R5 forms the control transistor for the baseemitter path of transistor T5.

The trigger stage in accordance with the present invention has the particular advantage that trigger signals can be applied thereto from various types of ignition systems without overloading of the trigger stage, and without requiring any particular or special matching or adjustment of the stage to a particular type of trigger signal.

Various changes and modifications may be made, and features described in connection with any one of the embodiments may be used with any of the others, within the scope of the inventive concept.

We claim:

1. For combination with an internal combustion engine having a battery supplied ignition system, (20,30), a fuel injection system including at least one fuel injection valve (2) and an electronic control circuit controlling operation of the fuel injection valve, the control circuit including a controlled power stage (10, 22-25) to provide injection pulses to the valve (2), and a trigger stage (21) connected to the ignition system of the engine to provide trigger pulses to the power stage, energized by the battery (B), wherein the trigger stage (21) comprises:

a voltage divider (R1, R2; R3);

a double-collector transistor (T6) having its base connected to the tap point (42) of the voltage divider, and a protective circuit (T1, T4, T5; T2, T7) protecting the input (C) of the trigger stage from overloading, and the remaining circuit components against undesired stray pulses when the trigger stage has input signals (S) applied thereto of excess energy level, said double-collector transistor (T6) being connected to the output (D) of the trigger stage (21) and hence to the power stage (10; 22-25) of the system, and being further connected to and controlling the protective circuit.

2. System according to claim 1, wherein one of the two collectors (b) of the double collector transistor (T6) is connected to the output (D) of the trigger stage, the other collector (a) being connected to and controlling operation of the protective circuit.

3. System according to claim 2, wherein the current division between the two collectors (*a*, *b*) of the double collector transistor (T6) is unequal.

4. System according to claim 3, wherein the current division between the two collectors (*a*, *b*) of the double collector transistor (T6) is relatively controlled to provide the output signal to the output terminal (D) of the trigger stage after passing the trigger threshold, and, upon further rise of the input signal, to provide output current from the other collector (*b*) to activate the protective circuit (T1, T4, T5; T2, T7).

5. System according to claim 4, wherein the voltage divider (R1, R2, R3) has a controllable voltage division ratio.

6. System according to claim 1, wherein the protective circuit includes the base-emitter path of a transistor (T2) connected to clamp the input signal (S) to a predetermined value when the input signal tends to have an excessive negative value.

7. System according to claim 1, wherein the protective circuit comprises the base-emitter path of a Darlington transistor stage (T2, T7) connected to the input terminal of the stage and clamping the input signal (S) to a predetermined value when the input signal tends to have an excessive negative value.

8. System according to claim 7, wherein the collector of the Darlington stage is connected to the positive supply bus ($U_B$; 35) of the system.

9. System according to claim 7, further comprising a protective resistor (R6) connected in the collector circuit of the Darlington stage.

10. System according to claim 6, wherein the collector of the transistor (T2) is connected to the negative supply bus (-B; 40) of the system.

11. System according to claim 1, wherein the voltage division ratio of the voltage divider (R1, R2; R3) is controlled to provide a voltage at the tap or junction point of the voltage divider which is in the upper half of the supply voltage ($U_B$) for the system.

12. System according to claim 1, further comprising a supply battery (B) supplying operating power to the fuel injection system;

and wherein the voltage divider (R1, R2; R3) is connected across said battery, and the junction or tap point of the voltage divider controls the trigger threshold of the trigger stage;

the system further comprising an ignition stage (20, 30) connected to said battery, and providing a signal to said trigger stage, whereby the threshold voltage determining the trigger threshold of the trigger state is equally voltage dependent as the input signal applied from the ignition stage to the trigger stage.

13. System according to claim 1, wherein the protective circuit further comprises a pnp transistor (T1) included in the protective circuit and connected such that its base-emitter junction prevents reverse polarity operation, and thus inverse operation of the protective circuit upon presence of a negative input signal (S) being applied to the protective circuit to bypass excessive positive trigger currents.

14. System according to claim 13, wherein the pnp transistor (T1) is a vertical transistor constructed in monolithic integrated circuit technology.

* * * * *